United States Patent [19]

Safar et al.

[11] 4,027,705

[45] June 7, 1977

[54] STRAND-BRAKING APPARATUS

[75] Inventors: Petr Safar; Josef Langr; Miloslav Kolar; Stanislav Nosek, all of Usti nad Orlici, Czechoslovakia

[73] Assignee: Vyzkumny Ustav Bavlnarsky, Usti nad Orlici, Czechoslovakia

[22] Filed: Apr. 8, 1976

[21] Appl. No.: 675,183

[30] Foreign Application Priority Data

Apr. 16, 1975 Czechoslovakia ..... 2617/75

[52] U.S. Cl. ..... 139/450; 242/149; 226/195; 242/157 R

[51] Int. Cl.[2] ..... D03D 47/34

[58] Field of Search ..... 139/429, 450, 452; 66/125; 226/38, 39; 242/149 X, 154, 157 X

[56] References Cited

UNITED STATES PATENTS

| | | | |
|---|---|---|---|
| 3,129,902 | 4/1964 | Juillard | 139/45 |
| 3,144,997 | 8/1964 | Brinke | 242/149 |

FOREIGN PATENTS OR APPLICATIONS

| | | | |
|---|---|---|---|
| 28,003 | 12/1910 | United Kingdom | 242/149 |

*Primary Examiner*—Henry S. Jaudon

[57] ABSTRACT

A strand advanceable from a supply spool to a weaving machine of the shuttleless type under variable tension is routed through an adjustable braking mechanism. The braking mechanism includes a flat guide plate along which the strand advances, the strand being contacted at longitudinally spaced portions of the guide plate by means of a succession of angularly depending leaf springs which are carried at longitudinal intervals in an overlying holding member. The input end of the holding member is pivotally supported on a frame member that carries the guide plate, and a helical spring biases the holding member obliquely relative to the underlying guide plate so that the distance between the holding member and the guide plate increases in the direction of advance of the strand. The angle formed by the depending leaf springs from the lower surface of the holding member successively increases, and the length of the depending arms are so chosen that the lower ends of the arms come into substantial registration on the upper surface of the guide plate through the intervening strand. A screw and lock nut mechanism is provided for selectively moving the holding member downwardly toward the guide plate against the force of the helical spring to vary the contact pressure of the resilient arms on the strand and also to increase the differential in contact pressure applied by the successive resilient arms.

9 Claims, 4 Drawing Figures

STRAND-BRAKING APPARATUS

BACKGROUND OF THE INVENTION

In certain types of weaving machines, i.e., shuttleless or air-jet looms, the weft thread to be intermittently inserted into the shed is correspondingly withdrawn from a supply bobbin in time-spaced intervals. The resulting pulling impulses of the thread yield an undesirable variation in tension on the strand, and serves to set up short-term longitudinal oscillations in the strand tension.

Such effects have been found to adversely affect the operation of the weft insertion mechanism of the associated shuttleless loom, and thereby leads to a diminution in the quality of the woven fabric.

In an attempt to avoid such disadvantages, certain types of strand-braking mechanisms have been inserted between the supply bobbin and the weft insertion portion of the associated loom. In one advantageous design of this type, the strand is advanced along the upper surface of a guide plate which is contacted at spaced longitudinal portions therealong by means of resilient arms, such arms serving to exert a certain contact pressure on the advancing strand. A plurality of strand-guiding eyelets are positioned between successive ones of the resilient arms at the inlet portion of the braking mechanism, whereby the strand follows a serpentine path between successive ones of the resilient arms through the intervening eyelet.

Unfortunately, when such designs are employed in systems having a relatively large variation in tension, an auxiliary braking mechanism must be disposed upstream of the inlet end thereof to exert a pre-equalization effect. Moreover, such designs lack flexibility in the fine adjustment of the contact pressure exerted on the strand by the successive resilient arms.

SUMMARY OF THE INVENTION

The braking apparatus of the instant invention is a self-confined braking facility which may be directly inserted between the supply bobbin and the weft insertion facilities of a shuttleless jet loom for compensating unwanted longitudinal oscillations of a discontinuously withdrawn strand from the bobbin in a flexible, efficient and inexpensive manner.

In an illustrative embodiment, which is of the general construction wherein the strand is passed over the upper surface of a guide plate and contacted by a plurality of resilient arms, the resilient arms are individually supported at their upper ends in an elongated holding member that is pivoted at one end to an upper portion of the frame on which the guide plate is mounted. A helical spring or other suitable arrangement compensates the weight of the holding member together with the resilient arms and simultaneously stabilizes said member in a position oblique to the guide plate.

The successive resilient arms extend downwardly and forwardly toward the upper surface of the guide plate at progressively increasing angles to the lower surface of the holding member, the length of the individual arms being so chosen that the lower ends of the arms terminate in aligned relation on the upper surface of the guide plate so that each contacts the intervening advancing strand. The strand advances in a linear manner through the plurality of the strand-retarding zones embodied by the area of contact of the successive resilient arms with the guide plate. As the strand advances past the last one of the zones, it is threaded through an aligned, elongated eyelet which is suitably affixed to the downstream end of the guide plate.

The contact pressure of the successive arms, and thereby the degree of retardation of the strand in the successive zones of contact, is adjustable i.e., by means of a threaded assembly which selectively pivots the holding member downwardly toward the guide plate against the force of the biasing spring. Each increment of downward movement of the holding member serves both to proportionally increase the contact pressure of the resilient arm on the strand and also to increase the contact force differential between the upstream and downstream zones of contact on the guide plate.

With this arrangement, the progressive increase of braking force established in the direction of advance of the strand is effective to almost completely eliminate the unwanted longitudinal oscillations of the thread caused by the discontinuity of withdrawal of the thread from the bobbin by the weft insertion mechanism of the loom. Additionally, by disposing a suction nozzle adjacent and longitudinally of the edge of the guide plate parallel to the advancing strand, impurities freed by the progressive retardation action of the braking arrangement may be quickly and efficiently removed on a continuous basis.

The braking arrangement is effective to compensate not only for abrupt discontinuities of the type inherent in a shuttleless loom, but also to compensate other types of tension variations, e.g., variations caused by a strand balloon which is inherently formed as thread is unwound from a supply bobbin in many types of weaving machines.

BRIEF DESCRIPTION OF THE DRAWING

The invention is further set forth in the following detailed description taken in conjunction with the appended drawing, in which.

DETAILED DESCRIPTION

Figure 1:
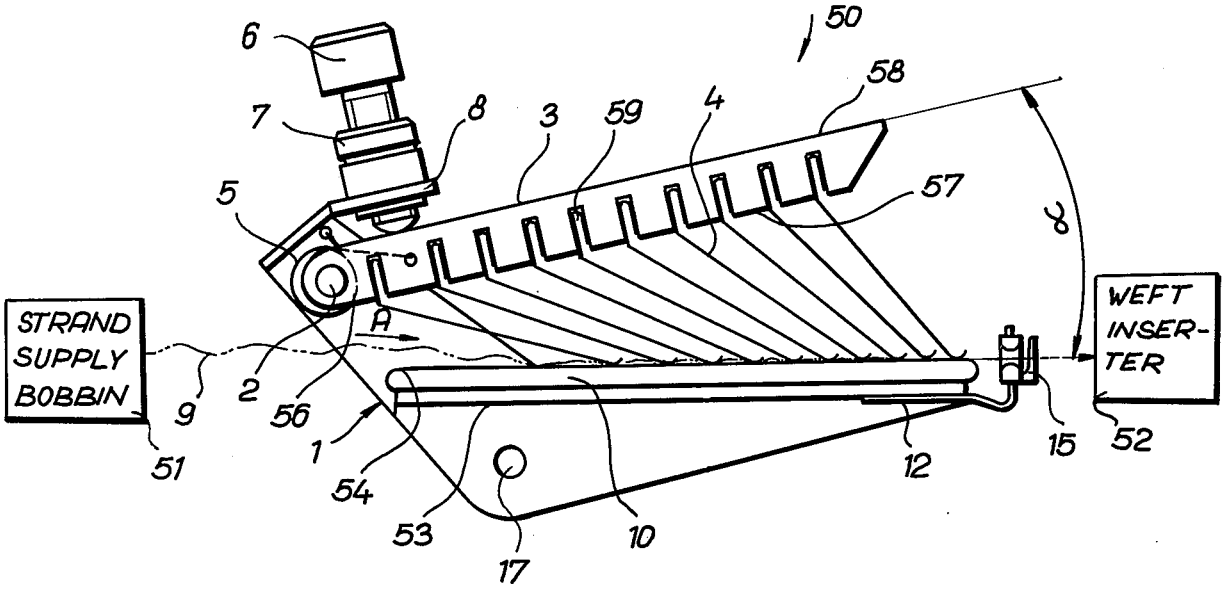
FIG. 1 is an elevational view of one embodiment of strand-braking apparatus constructed in accordance with the invention.

Referring now to the drawing, a braking apparatus 50 constructed in accordance with the invention is interposed in the path of linear advance of a strand 9 which is intermittently withdrawn from a bobbin 51 by means of a weft insertion mechanism 52 of a shuttleless or air-jet loom (not shown). As indicated in the dot-dash path of the strand 9 leaving the bobbin 51, the intermittent action of the weft inserter 52 is effective to impart longitudinal oscillations to the movement of the strand, the braking mechanism 50 acting in the manner described below to damp out such oscillations so that the portion of the strand downstream of the apparatus 50 is essentially devoid of such oscillations as shown.

The mechanism 50 includes a frame 1 to a lower end of which is secured a seat or bracket member 53. The bracket in turn carries an elongated guide plate 10 in substantially horizontal relation as shown, the plate 10 having an upper surface 54 along which the strand 9 is guided during its linear advance. One end 56 of an elongated holding member 3 is pivotally supported, as by pin 2, on an upper portion of the frame 1 in overlying relation to the guide plate 10. A helical spring 5, extending between the frame 1 and the holding member 3, is provided for normally biasing the holding member 3 obliquely upwardly relative to the guide plate 10, whereby the distance between a lower surface 57 of the member 3 and the upper surface 54 of the guide plate 10 progressively increases in the direction of advance of the strand 9. An upper surface 58 thereby defines an indicated angle $\alpha$ with respect to the surface 54. The holding member 3 exhibits a plurality of longitudinally spaced slots 59, 59 which extend substantially perpendicularly to the lower surface 57. The respective slots 59 are adapted to removably receive corresponding upper ends 61, 61 of a succession of resilient arms 4, 4, illustratively leaf springs. The arms 4 respectively exhibit intermediate portions 62, 62 which extend downwardly and forwardly toward the upper surface 54 of the guide plate 10, with an angle $\beta$ defined between each intermediate portion 62 and the lower surface 57 of the holding member 3 increasing progressively from the left end 56 of the member 3, and thereby increasing in the general direction of advance of the strand 9. The lengths of the intermediate sections 62 are chosen so that the respective lower ends (designated 11) of the portions 62 terminate in substantial horizontal alignment as shown, so that when the angle $\alpha$ is suitably adjusted, each of the lower ends 11 exerts a contact pressure on the underlying strand 9 advancing along the surface 54.

As appears from the foregoing, the lengths of the individual resilient arms 4 decrease in the direction of advance of the strand 9.

With the arrangement so far described, it will be evident that the contact pressure of the lower ends 11 on the guide plate 10 through the intervening strand 9 will progressively increase in the direction of advance of the strand 9, since the lower ends of the downstream arms 4 will be more nearly perpendicular to the guide plate 10 than will the upstream arms.

In order to adjust the contact pressure of the arms 4 against the surface 54, and also to adjust the degree of differential of the contact pressure in the downstream direction, there is provided a threaded contact member, in the form of a screw 6, which is supported on a threaded bracket 8 that is affixed to a top end of the frame 1. In particular, the screw 6 is arranged to be threaded in through the bracket 8 so that its lower end contacts the upper surface 58 of the holding member 3 by an adjustment amount, thereby pivoting the member 3 by a corresponding amount against the force of the helical spring 5 toward the upper surface 54 of the guide plate 10. Once a desired orientation of the holding member 3 is so obtained, its position can be secured by means of a lock nut 7.

In normal operation, the position of the holding member 3 is adjusted until the right-most resilient arm 4 corresponds to the desired degree of average tension of the strand 9 when it enters the weft inserter 52. When such right-most arm 4 is so adjusted, the contact pressure of the remaining arms on the strand 9 will progressively decrease in the upstream direction, with the left-most arm 4 exhibiting the least pressure.

Figure 4:
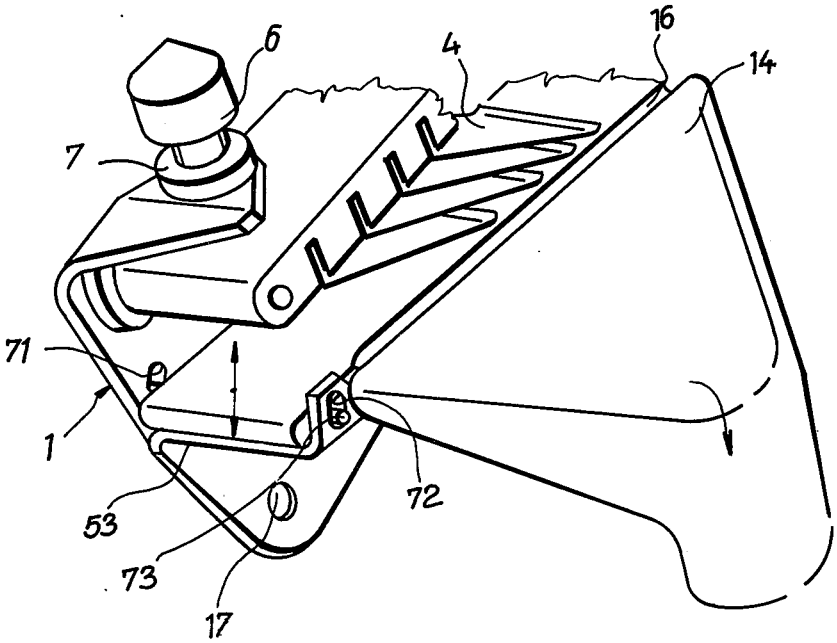
FIG. 4 is a fragmentary perspective view of the arrangement of FIG. 1, illustrating the cooperation of the braking mechanism with an associated suction nozzle for withdrawing impurities released from the advancing strand during the braking operation.

The progressive increase in retarding force that is applied at each zone of contact between a lower arm end 11 and the corresponding portion of the guide plate 10 is effective both to damp out the desired longitudinal oscillations of the thread 9 and to liberate certain impurities in the strand 9, such impurities being particularly marked when the strand is a cotton thread. Advantageously, as indicated in FIG. 4, an elongated suction nozzle 14 may be disposed adjacent an edge 16 of the guide plate 10 extending parallel to the direction of advance of the strand 9, whereby the liberated impurities may be continually withdrawn from the surface 54 as the strand advances.

Figure 3:
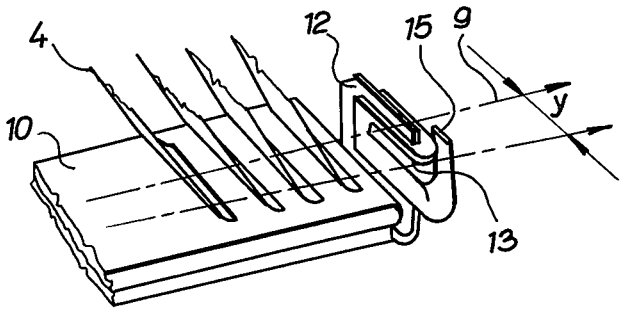
FIG. 3 is a fragmentary perspective view of the downstream end of the guide plate in the arrangement of FIG. 1, illustrating one form of self-threaded guiding eyelet through which the brake strand linearly advances.

The braking arrangement may also be provided with a guiding eyelet 15 that exhibits an elongated opening 13 in alignment with the top surface 54 of the guide plate 10. The eyelet 15 is supported via a bracket 12 to a downstream end of the plate-supporting seat member 53. The slot 13 extends parallel to the surface 54 and transverse to the direction of advance of the strand 9, so that the eyelet 15 will be self-threading even in the presence of deviations in the path of advance of the strand. The length of the slot 13 is indicated at $y$ in FIG. 3.

In the support frame there is provided a mounting hole 17 designed for securing the thread braking apparatus to a weaving machine.

Figure 2:
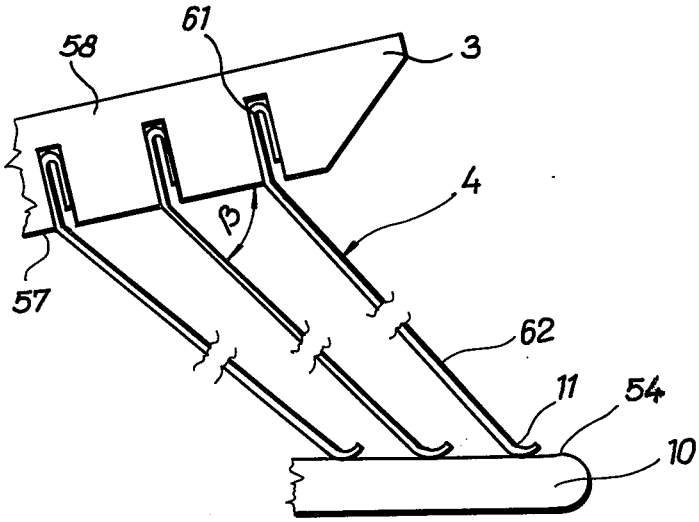
FIG. 2 is a fragmentary detail, in enlarged form, illustrating one manner in which the upper ends of the resilient arms of the braking apparatus of FIG. 1 can be supported in an associated holding member.

The lower ends 11 of the successive resilient arms 4 are advantageously bent in the direction of advance of the strand 9, as indicated in FIG. 2. In addition, in the embodiment shown in FIG. 2 the upper ends 61 of the arms 4 individually exhibit hairpin or U-shaped bends, thereby generating a large spring force in the direction toward the walls of the associated slot 59 in the holding member 3. In this way the arms 4 are tightly, albeit removably, held within the member 3. Alternatively, the arms 4 may be secured to the holding member 3 by any other convenient means, as by screws.

As shown in FIG. 4, the mounting bracket 53 may be made adjustable in a vertical direction relative to the position of the pivot pin 2 providing an elongated slot 71 in the frame 1, such slot cooperating with a suitable projection (not shown) on the member 53. Additionally, the position of the guide plate 10 on the seat member 53 may be adjusted by providing an additional slot 72 on the seat 53, such slot cooperating with a pin 73 on the guide plate 10. For this purpose, suitable pin locking arrangements may also be provided in a conventional manner.

The thickness, elasticity, width, etc., of the resilient arms 4 is a function of the properties of the strand 9, the frequency of oscillation to be damped, the magnitude of contact pressure desired, and various other factors, as is well-known to those skilled in the art. It has been found particularly advantageous to employ, for each resilient arm, a leaf spring in the form of a steel sheet having a thickness in the range of 0.05 – 0.15 mm and a width in the range of 10 – 30 mm.

In the foregoing, illustrative arrangement of the invention has been described. Many variations and modifications will now occur to those skilled in the art. It is accordingly desired that the scope of the appended claims not be limited to the specific disclosure herein contained.

What is claimed is:

1. In an apparatus for applying a braking force to a strand advanceable along a prescribed first path, a support frame, a guide plate carried by a lower portion of the frame and having an upper surface extending along the first direction adjacent the strand, an elongated holding member pivoted at one end to an upper portion of the frame, means for urging the holding member into a position oblique to the guide plate with the distance between the lower surface of the holding member and the upper surface of the guide plate increasing in the direction of advance of the strand, a plurality of resilient arms having upper ends individually supported by the holding member at longitudinally spaced intervals therealong, the successive resilient arms extending downwardly and forwardly toward the upper surface of the guide plate at progressively increasing angles to the holding member and terminable at their lower ends in substantial alignment with the upper surface of the guide plate to force the intervening portion of the strand against the guide plate, and means for selectively pivoting the holding member downwardly toward the guide plate against the force of the urging means to vary the differential contact pressure of the successive resilient arms against the guide plate through the intervening strand.

2. Apparatus as defined in claim 1, in which the lower surface of the holding means exhibits a plurality of longitudinally spaced recesses for removably receiving the upper ends of the resilient arms.

3. Apparatus as defined in claim 2, in which the upper ends of the resilient arms individually exhibit a substantially U-shaped bend for reception in the recesses of the holding member.

4. Apparatus as defined in claim 1, in which each resilient arm is a leaf spring.

5. Apparatus as defined in claim 1, further comprising a suction nozzle extending along an edge of the guide plate in the first direction.

6. Apparatus as defined in claim 1, further comprising a guiding eyelet supported in alignment with the upper surface of the guide plate at a downstream end thereof, whereby the strand is advanceable through the aligned opening in the eyelet.

7. Apparatus as defined in claim 6, in which the eyelet opening is in the form of a slot extending transverse to the first direction and parallel to the upper surface of the guide plate.

8. In a method for applying a braking force to a strand advanceable in a first linear direction, the steps of positioning a succession of strand-retarding zones at intervals along the first direction in the path of advance of the strand, and subjecting the strand to a successively increasing retarding force at the successive zones.

9. A method as defined in claim 8, further comprising the step of varying the amplitude of the difference in the retarding force respectively applied at successive zones along the path.

* * * * *